US007764252B2

(12) United States Patent
Miller et al.

(10) Patent No.: US 7,764,252 B2
(45) Date of Patent: Jul. 27, 2010

(54) ELECTROLUMINESCENT DISPLAY BRIGHTNESS LEVEL ADJUSTMENT

(75) Inventors: Michael E. Miller, Honeoye Falls, NY (US); Michael J. Murdoch, Rochester, NY (US); John E. Ludwicki, Churchville, NY (US)

(73) Assignee: Global OLED Technology LLC, Wilmington, DE (US)

( * ) Notice: Subject to any disclaimer, the term of this patent is extended or adjusted under 35 U.S.C. 154(b) by 1251 days.

(21) Appl. No.: 11/316,443

(22) Filed: Dec. 22, 2005

(65) Prior Publication Data

US 2007/0146252 A1 Jun. 28, 2007

(51) Int. Cl.
*G09G 3/30* (2006.01)

(52) U.S. Cl. ..... 345/77

(58) Field of Classification Search ..... 345/76, 345/77, 82, 204; 250/553
See application file for complete search history.

(56) References Cited

U.S. PATENT DOCUMENTS

| | | | | |
|---|---|---|---|---|
| 6,380,943 | B1 | 4/2002 | Morita et al. | |
| 6,384,836 | B1 * | 5/2002 | Naylor et al. | 345/589 |
| 6,690,117 | B2 | 2/2004 | Komiya | |
| 7,456,478 | B2 * | 11/2008 | Tsutsumi | 257/360 |
| 2001/0000217 | A1 | 4/2001 | Ono et al. | |
| 2001/0035850 | A1 | 11/2001 | Okamoto et al. | |
| 2003/0085905 | A1 | 5/2003 | Mori et al. | |
| 2003/0122494 | A1 | 7/2003 | Ide | |
| 2003/0122813 | A1 | 7/2003 | Ishizuki et al. | |
| 2004/0004444 | A1 | 1/2004 | Choi et al. | |
| 2004/0113875 | A1 | 6/2004 | Miller et al. | |
| 2005/0057191 | A1 | 3/2005 | Jo et al. | |
| 2005/0062696 | A1 | 3/2005 | Lo | |
| 2005/0212728 | A1 | 9/2005 | Miller et al. | |

FOREIGN PATENT DOCUMENTS

| | | |
|---|---|---|
| WO | 2004/023446 | 3/2004 |

* cited by examiner

*Primary Examiner*—Richard Hjerpe
*Assistant Examiner*—Tom V Sheng
(74) *Attorney, Agent, or Firm*—Morgan Lewis & Bockius LLP

(57) ABSTRACT

An electroluminescent display system, comprising: a) a display composed of an array of regions, wherein the current to each of the regions is provided by a pair of power lines and wherein each region includes an array of light emitting elements for emitting light; b) a pixel driving circuit for independently controlling the current to each light-emitting element in response to an image signal, wherein the intensity of the light output by the light emitting elements is dependent upon the current provided to each light emitting element; and c) a display driver for receiving an input image signal and generating a converted image signal for driving the light emitting elements in the display, wherein the display driver analyzes the input image signal to estimate the current that would result at, at least, one point along at least one of the power lines providing current to each of the regions, if employed without further modification, based upon device architecture and material and performance characteristics of device components, and generates the converted image signal as a function of the input image signal and the estimated currents.

6 Claims, 10 Drawing Sheets

ELECTROLUMINESCENT DISPLAY BRIGHTNESS LEVEL ADJUSTMENT

FIELD OF THE INVENTION

The present invention relates to electroluminescent display systems and a method for automatically adjusting the behavior of an electroluminescent display dependent upon input image information.

BACKGROUND OF THE INVENTION

Emissive display technologies, including displays based on cathode-ray tubes (CRTs) and plasma excitation of phosphors have become very popular within many applications. This is typically due to the fact that these technologies natively have superior performance characteristics over reflective or transmissive display technologies, such as displays produced using liquid crystals (LCDs). Among the superior characteristics of these displays is higher dynamic range, wider viewing angle, and, often, lower power consumption. The power consumption of emissive display technologies, however, is directly dependent upon the signal that is input to the display device since the typical emissive display will require almost no power to produce a black image but a significantly higher power to produce a highly luminous white image. More recently, organic light emitting diodes (OLEDs) have been discussed for use in displays and other light emitting devices. Like CRTs and plasma displays, devices constructed based on OLEDs are emissive and have the characteristic that power consumption is dependent upon the input signal.

It is known to control the power of an emissive display by controlling the input signal to the display. For example, U.S. Pat. No. 6,380,943 entitled "Color Display Apparatus", US 2001/0035850 entitled "Image reproducing method, image display apparatus and picture signal compensation device". US 2003/0085905 entitled "Control apparatus and method for image display", US 2001/0000217 entitled "Display Apparatus". US 2003/0122494 entitled "Driving Device for Plasma Display Panel" all discuss methods for controlling the power of an emissive display, generally plasma displays, wherein the power is estimated for each field or frame of an image signal and the data signal is scaled as a function of some estimate of the average field or frame power to control the overall power of the emissive display. The primary goals of the methods described within these disclosures are to reduce the peak power requirements of the display devices and/or to control the heat that is generated within these display devices. However, these disclosures do not address the fact that active matrix electroluminescent displays such as OLED displays use a driving arrangement that is significantly different in structure than is applied in plasma displays and therefore require a different approach to power reduction to avoid imaging artifacts while reducing the power of the display device.

In a typical voltage-driven active matrix OLED, a pixel driving circuit is provided that regulates the current provided to each OLED within the display device based upon a separate data voltage signal. The current supplied to the OLED by this pixel driving circuit is also somewhat dependent upon the voltage supplied to the circuit by a pair of power lines, comprising a supply power line and a return power line. Ideally, the voltage supplied by the power lines is will be constant for each pixel driving circuit. However, current is typically provided to a large number of OLEDs by a single pair of power lines. Because the power lines have a finite resistance, an unintended voltage differential is produced that is proportional to the current that is conducted through each power line and the resistance of each power line. Since the unintended voltage differential is positively correlated with current and resistance, the loss of voltage along the power lines will be larger when the lines carry high currents or when the lines have a high resistance. This results in variation in the voltage supplied to each pixel driving circuit along the power lines, and subsequent variation in both the current and luminance of each OLED supplied by the power lines. The phenomenon that produces this unintended voltage differential is commonly referred to as "IR drop". Further, because the resistance of the power lines increases with length, this IR drop will result in the gradual loss of luminance for OLEDs along the power lines as the distance from the power source increases. This loss of luminance has the potential to create undesirable imaging artifacts. Therefore, there is a need to limit unintended voltage drops to avoid these artifacts. IR drop may also occur in electroluminescent display devices which employ other active matrix drive schemes and can result in undesirable imaging artifacts when using these drive schemes as well.

One method to overcome this problem is to reduce the resistance of the power lines as suggested in US 2004/0004444 entitled "Light emitting panel and light emitting apparatus having the same". Resistance can be reduced by using more conductive materials or by increasing the cross-sectional area of the power lines. In some cases, a highly conductive plane of material can be used in place of one or more individual power lines to reduce the resistance, but this depends on the structure of the device, and it is not always possible to find materials with sufficient properties and/or methods to produce this plane of material. Similarly, the materials that are available to reduce resistance and the cross-sectional area of individual power lines are often fixed by the manufacturing technology that is available, so it is often not cost effective to reduce the resistance of the power lines. Finally, in larger displays, the power lines are typically longer and there are a larger number of OLEDs connected to each set of lines. The power lines therefore tend to have higher resistance and tend to carry higher currents than those on smaller displays. This often limits the size or luminance of displays that can be produced using OLED technology.

It should further be noted that this effect is reduced when the power efficiency of the OLED display device is improved, because less current is needed to produce a given OLED luminance. Therefore, if methods could be developed to reduce the artifacts that occur as a function of IR drop, it may be possible to employ these methods in conjunction with methods to reduce the power of the OLED display device, such as the use of more efficient subpixels as described in US 2004/0113875 entitled "Color OLED display with improved power efficiency" and US 2005/0212728 also entitled "Color OLED display with improved power efficiency" to produce larger and/or higher luminance OLED displays than can be provided using more conventional RGB technology.

It has been suggested that automatic brightness limits can be imposed on OLED displays to limit their power. U.S. Pat. No. 6,690,117 entitled "Display device having driven-by-current type emissive element" discusses a resistor that is placed between the power source and the power lines of an OLED display device. A current dependent voltage drop then takes place across this resistor, reducing the voltage when high currents are present (i.e., when the display has a high relative luminance). This results in a lower data voltage at every OLED in the display and therefore reduces the current that is required at each OLED at the cost of lower luminance.

The voltage drop across this resistor can also be sensed and the contrast of the input signal can be modified, dependent upon the voltage drop. While this technique does reduce the peak currents that must be delivered and therefore limits the voltage drop that can occur across the power lines due to IR drop, this technique does not allow a predictable response at each OLED. In fact, it can actually result in additional undesirable artifacts as some TFTs in the panel may be driven at a voltage level below their saturation region, resulting in a further reduction, and more variability, in the current conducted through the OLEDs for a given data voltage. For this reason, the technique taught, while controlling the power of an active matrix OLED display, can contribute to unintended luminance non-uniformities in the display device, reducing the quality of the image that is displayed.

US20050062696 entitled "Display apparatus and method of a display device for automatically adjusting the optimum brightness under limited power consumption" provides a function similar to U.S. Pat. No. 6,690,117 as a resistor is attached to the cathode which also results in reducing the voltage drop across an OLED in the presence of high currents. This approach does not, however, solve the problems associated with the earlier disclosure and does not provide a method for adjusting the contrast in response to changes in display luminance.

In any digitally implemented automatic brightness level scheme a significant component is the method that is used to estimate the quantity that is to be limited. U.S. Pat. No. 6,380,943 entitled "Color Display Apparatus" particularly discusses a method for controlling the power consumed wherein this method includes a method for estimating the power consumed by a RGB display, which might include a "light emission diode apparatus". Within the power estimation method, the power consumed by each color channel is calculated individually using different gains and the resulting values are summed to compute the total power. Generally, the method for controlling the power is applied to the entire field or frame of data. This disclosure does recognize that it may be desirable to update a portion of a display device at a time to reduce memory requirements and therefore power may be computed for a sub-region within the display at a time. However, the described methods can still result in objectionable artifact levels as this disclosure does not recognize or propose a solution to the problem that IR drop can be different for different power lines and that different luminance levels may result between light emitting elements driven by neighboring power lines when high current loads are present.

There is a need, therefore, for a method that reduces apparent artifacts in an electroluminescent displays such as an OLED display that can result when driving the display such as to require high current levels along power lines with a finite resistance in order to enable the manufacture of larger and/or brighter displays.

SUMMARY OF THE INVENTION

In accordance with an embodiment of the invention, an electroluminescent display system is described, comprising: a) a display composed of an array of regions, wherein the current to each of the regions is provided by a pair of power lines and wherein each region includes an array of light emitting elements for emitting light; b) a pixel driving circuit for independently controlling the current to each light-emitting element in response to an image signal, wherein the intensity of the light output by the light emitting elements is dependent upon the current provided to each light emitting element; and c) a display driver for receiving an input image signal and generating a converted image signal for driving the light emitting elements in the display, wherein the display driver analyzes the input image signal to estimate the current that would result at, at least, one point along at least one of the power lines providing current to each of the regions, if employed without further modification, based upon device architecture and material and performance characteristics of device components, and generates the converted image signal as a function of the input image signal and the estimated currents.

In accordance with various embodiments, the present invention provides a system and method that reduces apparent artifacts in an electroluminescent display such as an OLED display that can result when driving the display such as to require high current levels along power lines with a finite resistance in order to enable the manufacture of larger and/or brighter displays. The invention may additionally reduce the overall power consumed by the display, as well as reduce the heat that is generated within the display. Alternately, the invention may increase the luminance of the display device without creating the artifacts that would typically be present. Further, the invention preferably additionally provides these advantages on a display having more than three-color channels.

DETAILED DESCRIPTION OF THE INVENTION

The present invention provides a display system including a display driver that analyzes the input signal to an electroluminescent display and modifies this signal to limit the maximum unintended difference in current draw among regions of the display where the regions represent groups of light-emitting elements, such as OLEDs, that are driven by neighboring pairs of power lines.

More specifically an electroluminescent display system is provided, comprising: a display composed of an array of regions, wherein the current to each of the regions is provided by a pair of power lines and wherein each region includes an array of light emitting elements for emitting light; a pixel driving circuit for independently controlling the current to each light-emitting element in response to an image signal, wherein the intensity of the light output by each light emitting element is dependent upon the current provided to the light emitting element; and a display driver for receiving an input image signal and generating a converted image signal for driving the light emitting elements in the display, wherein the display driver analyzes the input image signal to estimate the current that would result at, at least, one point along at least one of the power lines providing current to each of the regions if employed without further modification, based upon device architecture and material and performance characteristics of device components, and generates the converted image signal as a function of the input image signal and the estimated currents. While it is required to estimate the current that would result at, at least one point along at least one of the power lines providing current to each of the regions, when both of the power supply and return lines have a significant finite resistance it is preferable to estimate the current at, at least, one point along each of the power lines in the pair of power lines providing current to each of the regions.

Figure 1:
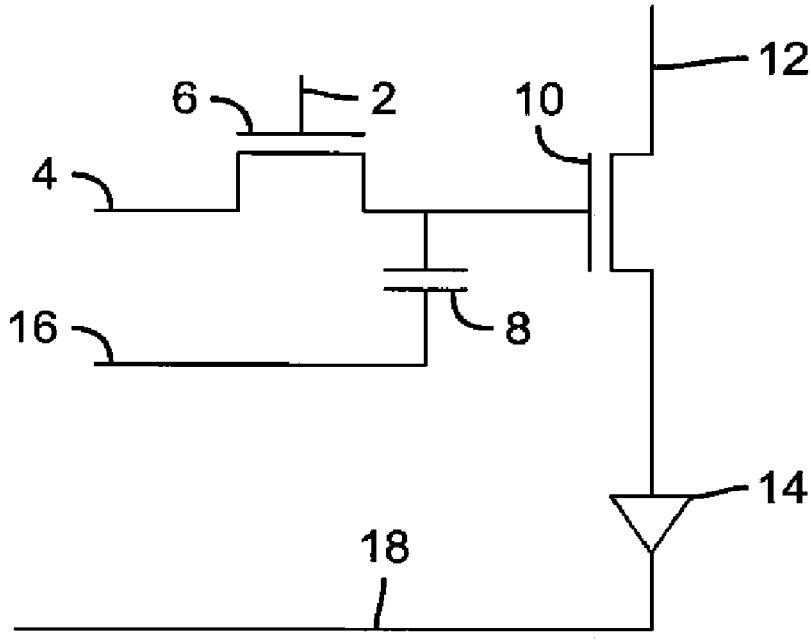
FIG. 1 is a circuit diagram showing a circuit useful in driving a voltage-driven, active matrix display device of an embodiment of the current invention.

The invention may be practiced in active matrix displays having any number of pixel driving circuits for controlling the current provided to an electroluminescent light-emitting element such as an OLED as are known in the art. However, one driving circuit useful for regulating the current across an OLED that forms a light emitting element in accordance with one embodiment of the current invention is shown in FIG. 1. As shown in this figure, this circuit is composed of a select line 2, a data line 4, a select TFT 6, a capacitor 8, a power TFT 10, a supply power line 12, OLED 14, a capacitor line 16 and a return power line 18. To drive the OLED to a desired luminance, a signal is provided on the select line 2, activating the select TFT 6. The voltage provided on the data line 4 is then used to charge the capacitor 8 to the desired voltage. When this voltage is available to the power TFT 10, the power TFT is activated and current is allowed to flow to the OLED 14. The circuit is completed through the return power line 18 to the power supply.

Within this drive scheme, the current provided across the OLED 14 is ideally dependent upon only the characteristics of the power TFT 10 and the voltage provided by the data line 4. In fact, the current provided across the OLED 14 is dependent upon other factors, including the gate-to-source and drain-to-source voltages across the power TFT 10. In FIG. 1, a voltage will be present at the gate 20 of the power TFT 10. Different voltages may be present at 22, commonly referred to as the source for p-type TFTs and as the drain for n-type TFTs. A third voltage may be present at 24, which is commonly referred to as the drain for p-type TFTs and the source for n-type TFTs. Therefore, voltage variation on the supply power line 12 and the return power line 18, due to IR drops along these lines, can alter the current provided across the OLED 14. In the case where the power TFT 10 is an n-type transistor, as is the case in an amorphous silicon (aSi) device, any variation in the voltage provided by the supply power line 12 results in variation of both the gate-to-source and drain-to-source voltages across the power TFT 10. Similarly, variations in the voltage provided by the return power line 18 results in variation of the drain-to-source voltage across the power TFT 10. In the case where the power TFT 10 is a p-type transistor, as is typically the case in a low-temperature polysilicon (LTPS) devices, any variation in the voltage provided by the supply power line 12 results in variation of drain-to-source voltage across the power TFT 10. Similarly, variations in the voltage provided by the return power line 18 results in variation of both the gate-to-source and drain-to-source voltages across the power TFT 10. Further, the IR drops that cause these voltage variations on the power lines are not constant but vary as a function of the current required to drive the OLEDs along the power line pairs.

In a typical active matrix OLED display, several light emitting elements share a common pair of power lines. The supply power lines are often laid out to run in the horizontal or vertical axis of the display. These supply power lines often share a layer in the back plane of the display with other components, often the select lines. Therefore, these supply power lines often provide power to a narrow horizontal or vertical area of the display. The return power lines, on the other hand, are often constructed as a return power plane on top of the electroluminescent layers of the display. In some cases, the return power plane is connected to separate return power lines, similar to the supply power lines, on the backplane of the display. The need for these return power lines on the substrate is dependent upon the conductivity of the material used to create the return power plane. In other cases, each light emitting element of the OLED display is separately connected to a return power line on the substrate. In this later case, the return power lines often return power from a narrow horizontal or vertical area of the display. When the return power line is constructed as a return power plane, it is possible that the return power line will have a significantly lower resistance than the supply power line. Under circumstances where one of the pair of power lines has a significantly lower resistance than the other, it may be adequate to estimate the current at, at least one point along the power line having the higher resistance.

Figure 2:
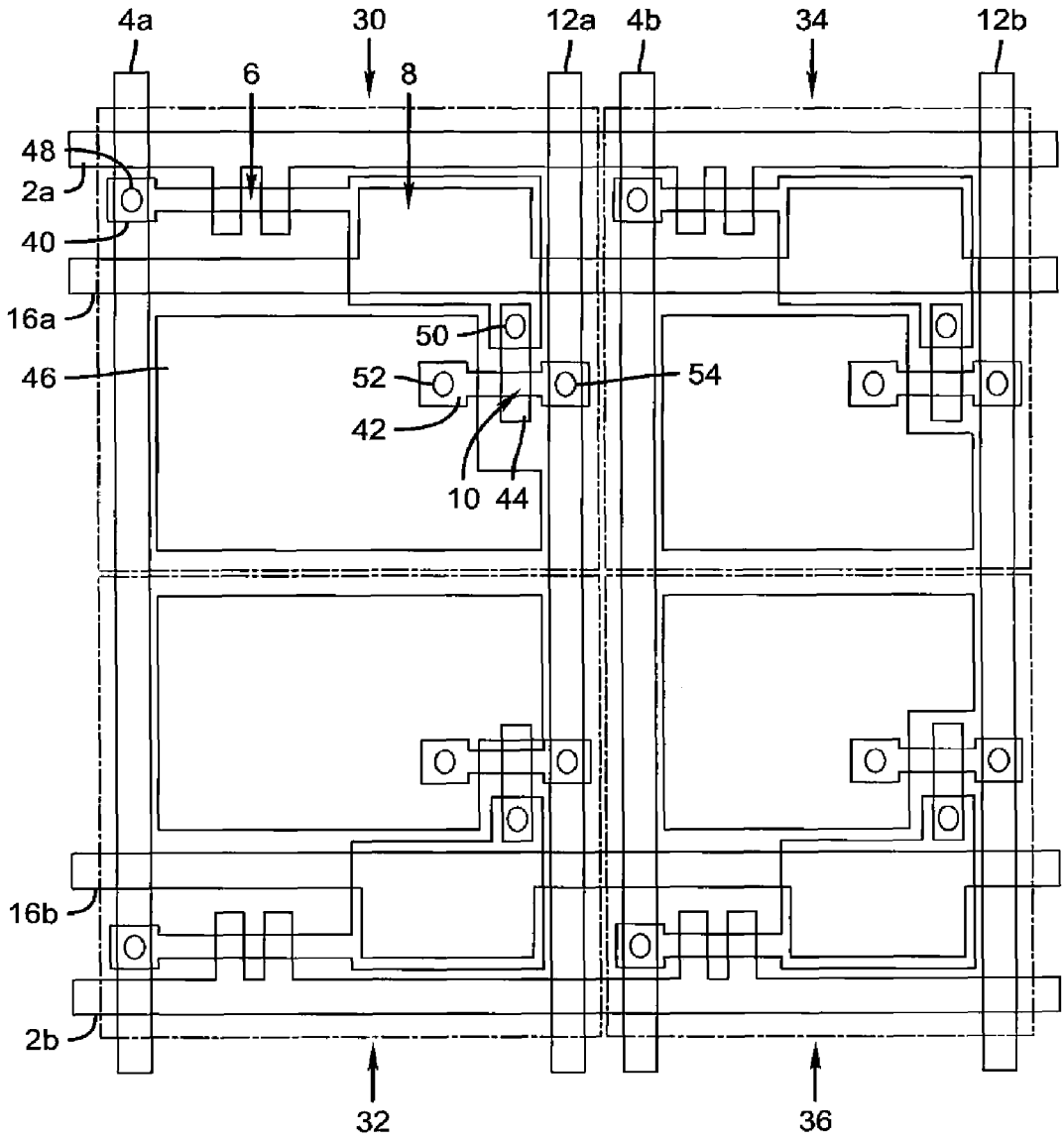
FIG. 2 is a top view of a display substrate for a display useful for practicing an embodiment of the present invention.

A layout diagram for the portions of the drive circuitry used to drive four neighboring light emitting elements 30, 32, 34, and 36 is shown in FIG. 2. FIG. 2 shows the construction of the various circuit components such as select transistor 6, storage capacitor 8, and power transistor 10. The drive circuitry components are fabricated using conventional integrated circuit and thin film transistor fabrication technologies. Select transistor 6 is formed from a first semiconductor region 40 using techniques well known in the art. Select transistor 6 is shown as a double gate type transistor, however, this is not required for successful practice of the present invention and a single gate type transistor could also be used. Similarly, power transistor 10 can be formed in a second semiconductor region 42. The first semiconductor region 40 and second semiconductor region 42 are typically formed in the same semiconductor layer. This semiconductor layer is typically silicon and is preferably polycrystalline or crystalline, but can also be amorphous. This first semiconductor region 40 also forms one side of storage capacitor 8. Over the first semiconductor region 40 and second semiconductor region 42 is an insulating layer (not shown) that forms the gate insulator of select transistor 6, the gate insulator for power transistor 10, and the insulating layer of storage capacitor 8. The gate of select transistor 6 is formed from part of select line 2*a*, which is formed in the first conductor layer. Power transistor 10 has a separate power transistor gate 44 also preferably formed in the first conductor layer. The other electrode of storage capacitor 8 is formed as part of capacitor line 16*a*, also preferably formed from the first conductive layer. Power line 12*a* and data line 4*a* are preferably formed from a second conductive layer. One or more of the signal lines (e.g. select line 2*a*) frequently cross at least one or more of the other signal lines (e.g. data line 4*a*), which requires these lines to be fabricated from multiple conductive layers with at least one interlayer insulating layer (not shown) in between. A first electrode 46 of the organic light emitting diode is connected to power transistor 10. An insulating layer (not shown) is located between the first electrode 46 and the second conductive layer.

Connections between layers are formed by etching holes (or vias) in the insulating layers such as via 48 connecting data line 2*a* to the first semiconductor region 40. Similarly, via 50 connects the power transistor gate 44 to first semiconductor region 40, via 54 connects the second semiconductor region 42 to power line 12*a*, and the via 52 connects the second semiconductor region 42 the first electrode 46.

First electrode 46 serves to provide electrical contact to the organic electroluminescent media of the organic light emitting elements. Over the perimeter edges of the first electrode 46, an intersubpixel dielectric layer (not shown) may be formed to cover the edges of said electrodes and reduce shorting defects as described below. The area of the first electrode 46, which is in electrical contact with the organic electroluminescent media, reduced by any area covered by dielectric material, defines the emitting area of light emitting element 30. Within this arrangement, a sheet of conductive material that is sputtered over the entire back of the display and acts as a highly conductive return power line, or return power plane (not shown).

While this embodiment refers to a specific configuration of active matrix drive circuitry and subpixel design, several variations of conventional circuits that are known in the art can also be applied to the present invention by those skilled in the art. For example, one variation in U.S. Pat. No. 5,550,066 connects the capacitors directly to the power line instead of a separate capacitor line. A variation in U.S. Pat. No. 6,476,419 uses two capacitors disposed directly over one and another, wherein the first capacitor is fabricated between the semiconductor layer and the gate conductor layer that forms gate conductor, and the second capacitor is fabricated between the gate conductor layer and the second conductor layer that forms power lines and data lines.

While the drive circuitry described herein requires a select transistor and a power transistor, several variations of these transistor designs are known in the art. For example, single- and multi-gate versions of transistors are known and have been applied to select transistors in prior art. A single-gate transistor includes a gate, a source and a drain. An example of the use of a single-gate type of transistor for the select transistor is shown in U.S. Pat. No. 6,429,599. A multi-gate transistor includes at least two gates electrically connected together and therefore a source, a drain, and at least one intermediate source-drain between the gates. An example of the use of a multi-gate type of transistor for the select transistor is shown in U.S. Pat. No. 6,476,419. This type of transistor can be represented in a circuit schematic by a single transistor or by two or more transistors in series in which the gates are connected and the source of one transistor is connected directly to the drain of the next transistor. While the performance of these designs can differ, both types of transistors serve the same function in the circuit and either type can be applied to the present invention by those skilled in the art. The example of the preferred embodiment of the present invention is shown with a multi-gate type select transistor 6.

Also known in the art is the use of multiple parallel transistors, which are typically applied to power transistor 10. Multiple parallel transistors are described in U.S. Pat. No. 6,501,448. Multiple parallel transistors consist of two or more transistors in which their sources connected together, their drains connected together, and their gates connected together. The multiple transistors are separated within the light emitting elements so as to provide multiple parallel paths for current flow. The use of multiple parallel transistors has the advantage of providing robustness against variability and defects in the semiconductor layer manufacturing process. While the power transistors described in the various embodiments of the present invention are shown as single transistors, multiple parallel transistors can be used by those skilled in the art and are understood to be within the spirit of the invention.

As will be shown later, it is important to this invention that some regions of light emitting elements are provided power by different supply power lines. In the embodiment depicted in FIG. 2, light emitting elements are provided power by separate power lines for each column of light emitting elements. For example, light emitting elements 30 and 32 are provided power by supply power line 12*a* while light emitting elements 34 and 36 are provided power by supply power line 12*b*. It should also be noted that the supply power lines 12 must share the area with other components on the backplane. For example, the supply power lines 12, select lines 2, and at least portions of the power TFT 10 will typically be formed in one layer of the substrate. Further in bottom emitting OLED embodiments, these components are fabricated on a layer that is typically between the viewable side of the display and its light emitting layer. Since the supply power lines 12, select lines 2, and power TFT materials 10 are typically opaque, these components typically are designed so as not to overlap the emitting area as defined by the first electrode 46. These constraints limit the width of the supply power line 12 within traditional backplane designs. It is further known that the performance of the power TFT is directly related to its thickness and therefore the thickness of the supply power line 12 is often constrained to match the desired thickness of the power TFT, which is typically formed from the same metal layer. For these reasons, both the width and thickness of the power line is often constrained and the metals that are commonly used to form this layer (e.g., Aluminum) often have a significant, finite amount of resistance.

It is further understood that, due to the finite resistance of the supply power line, voltage losses may occur along the supply power line when the supply power line is subjected to high currents and that high currents will be required when the power lines must supply power to a large number of light emitting elements or the light emitting elements each require a high current to achieve a high luminance. In fact, the voltage loss will be proportional to the product of the resistance and current. Therefore, voltage will dissipate as a function of the distance along the power line. This dissipation will happen along the power and the return lines. In a circuit such as shown in FIG. 1, the voltage at the gate of the power TFT 10 directly affects the current that is provided across the OLED and since the light output of an OLED is directly proportional to the current that it is subjected to, a loss in voltage along the power line 12 will result in lower light output for light emitting elements connected to a common power line that are furthest from the point where the power line is connected to an external power supply, where this loss of light output is proportional to the resistance of the power and return lines as well as the current that is required to display a desired input image signal.

Fortunately, the human visual system is relatively insensitive to low spatial frequency changes in luminance. Therefore, within a typical desktop or wall-mounted display, the luminance may vary by as much as 30 percent across the height or width of the display without being observable or at least objectionable to the human observer. Therefore, under many circumstances, the loss in voltage and the corresponding loss in display luminance with distance from the power supply may not result in substantial image quality artifacts. This is particularly true when displaying flat fields and many typical images. However, the inventors have determined that these unintended luminance variations resulting from IR drop along power lines can under certain circumstances be directly observed and objectionable to users of the display device. The inventors have also observed that while the artifacts may not be directly observable when viewing many typical images, these unintended luminance variations can degrade local contrast and therefore reduce the overall image quality.

Figure 3:
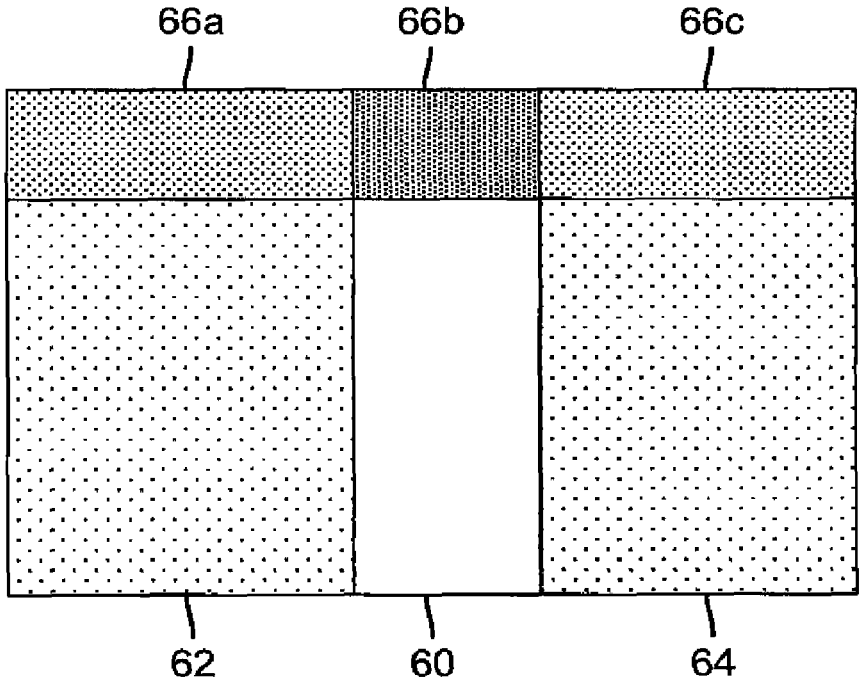
FIG. 3 PRIOR ART
FIG. 3 is a depiction of an image artifact shown on a display driven using prior art drive methods.

FIG. 3 shows a depiction of one such set of observable conditions. This figure depicts a resulting image from a typical OLED display device having a power connector at the bottom of the display. When this display is driven using currents that are large enough to result in a significant voltage drop along power lines that run from the bottom to the top of the display device, artifacts can occur. As shown in this figure, a white area 60 is displayed that has a high current draw. While this white area 60 may be higher in luminance near the bottom of the display where the power lines enter the display than near the top of the display, because this luminance changes gradually, the human eye is incapable of detecting this gradual change. To either side of this white area, two black areas 62 and 64 are displayed. A gray bar 66 is displayed across the entire top of the display. While displayed using the same input voltage, gray bar 66 is not uniform in luminance due to different IR drops along the different power lines driving the areas 66*a*, 66*b* and 66*c* as a result of the different currents drawn in area 60 relative to that in areas 62 and 64. In fact, the areas 66*a* and 66*c*, which are driven by the same power lines as the two black areas 62 and 64 are significantly higher in luminance than the area 66*b*, which is driven by the same power lines as is the white area 60. Unlike the gradual change in luminance of the white bar from the bottom to the top of the display, the change in luminance across the area 66, which is intended to be uniform, is sudden and visible. The luminance change occurs between neighboring OLEDs at the boundary between 66*a* and 66*b* and the boundary between 66*c* and 66*b*, due the resulting difference in current between neighboring power lines. This sudden and unintended change in luminance is very detectable to the human eye and presents a very undesirable display artifact. It is the intent of embodiments within this disclosure to reduce the luminance variation that can occur between neighboring OLEDs that are driven by neighboring power lines when the peak luminance of the display is such that currents are high enough to create artifacts of this type.

Figure 4:
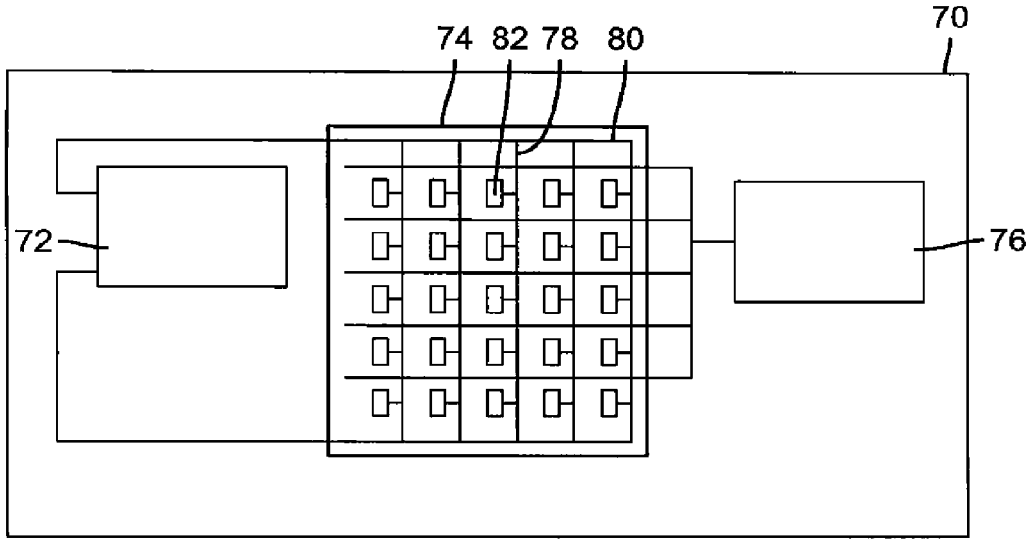
FIG. 4 is a depiction of the components in a display system of an embodiment of the present invention.

To overcome this artifact, an OLED display system 70 is provided as shown in FIG. 4. This OLED display system 70 includes a power supply 72, which provides power to the display 74, and a display driver 76 for receiving an input image signal and generating a converted image signal for driving the light emitting elements in the display 74. The display 74, a portion of which is depicted in FIG. 2, contains an array of power lines 78 for providing current to an array of regions (in this embodiment columns) on the display 74 wherein each region includes an array of light emitting elements 82 and pixel driving circuitry for responding to the converted image signal to control the current to each light emitting element. It should once again be noted that the power supply 72 is a conventional power supply as is known in the art and the display is any display having current driven light emitting elements wherein the current to the light emitting elements are actively controlled using a pixel driving circuit.

To avoid the artifacts as were shown in FIG. 3 the display driver will generate a converted image signal that limits or reduces the unintended variation in current draw and therefore luminance output from light emitting elements within neighboring regions of the display 74. In one embodiment, the display driver limits the unintended variation in current supplied to light-emitting elements in neighboring regions of a display by generating the converted image signal as a function of one or more normalization constants based on the relative values of the estimated current values and a reference value. Such correction may be achieved, e.g., by applying a method comprised of the following steps shown in FIG. 5: 1) determining 90 the light emitting elements in the display device that receive current from each power line, 2) receiving 92 an input image signal, 3) estimating 94 the current at, at least, one point along each power line if the input image signal were to be displayed, 4) determining 96 one or more correction factors based upon the estimated current to be provided by a power line where the one or more correction factors is compared to a reference current value, 5) applying 98 the one or more correction factors to the image signal to generate a converted image signal, this converted image signal producing final image with reduced unintended current variations between light-emitting elements in neighboring regions of the display device, and 6) displaying 100 the converted image signal.

In one specific embodiment, the display driver may estimate peak currents for each power line and compute a normalization constant based on the ratio of the maximum estimated peak current to the reference value, and apply the normalization constant to the input image signal to generate the converted image signal. The display driver may in an alternative embodiment generate the converted image signal by computing modified normalization constants for each region of the display as a filtered version of an initial set of normalization constants computed for neighboring regions. In either of such embodiments, the display driver may further generate converted image signals for individual input image signals in a temporal image sequence by computing modified normalization constants for the multiple input image signals as a filtered version of an initial set of normalization constants computed for individual images in the sequence.

Figure 5:
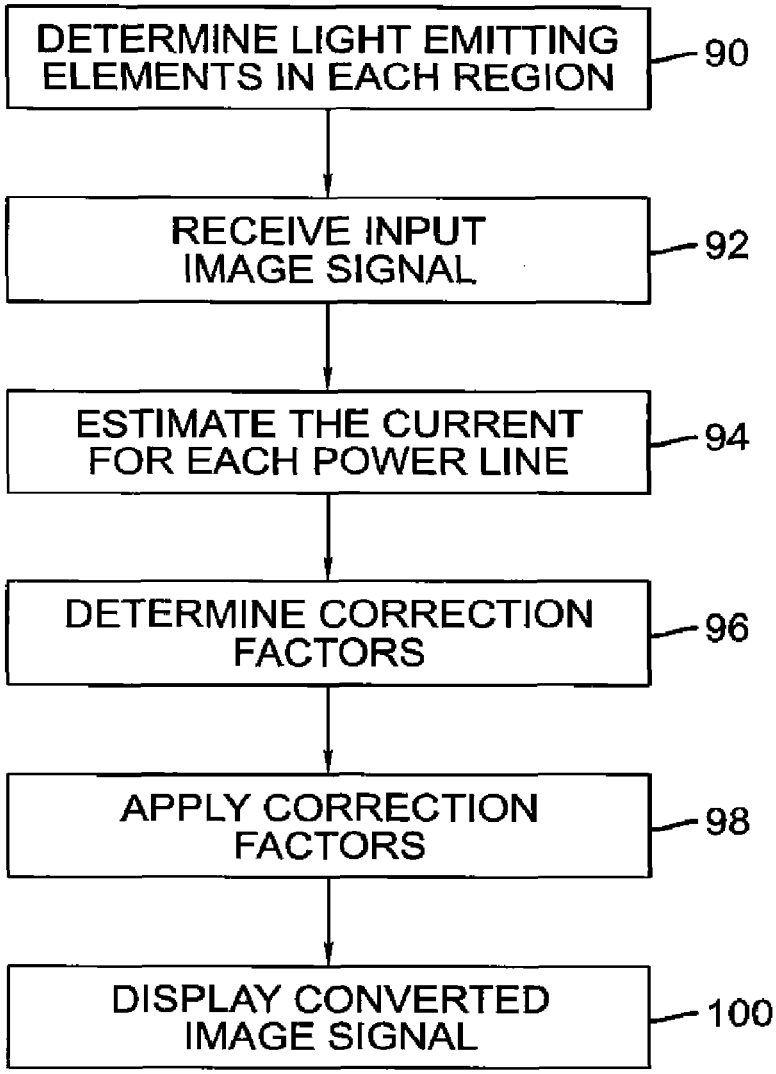
FIG. 5 is a flow diagram depicting steps of a process for driving a display according to an embodiment of the present invention.

Within embodiments of FIG. 5, the reference current value will generally be a maximum current value that is established such that for the given resistance of the power and return lines, the maximum voltage drop across the length of the power line is small enough that the maximum unintended variation in current between light emitting elements within neighboring regions is acceptable. Within applications, such as graphical displays, that tend to use large areas of uniform color, this maximum voltage drop may be such that the luminance difference between neighboring regions (e.g., 66*a* and 66*b*) when displaying a target similar to the one shown in FIG. 3 is less than 5 percent and preferably less than 2 percent, which is near the threshold of visibility for the human eye. In imaging applications where the absence of large areas of nearly uniform color may hide this artifact to some degree, this maximum voltage drop may be such that the resulting luminance difference between neighboring regions is 10 percent or less but preferably less than 2 percent.

The correction factor or factors may be used to decrease the current used to drive one or more light-emitting elements within a display device and to therefore reduce the power required to drive the display device. In some embodiments of the present invention, the correction factor or factors may be used to increase the current used to drive one or more of the OLEDs of an OLED electroluminescent display device. When the correction factor(s) are used to increase the current of one or more of the OLEDs, this increase in current will increase the power required to drive the display device but may also result in a display device having an increased peak luminance and therefore an increased perceived brightness.

However, in all embodiments, the resulting image that is displayed will have a reduced level of unintended luminance variation for a given peak luminance level.

In a second embodiment, the display driver limits the unintended variation in current draw between light-emitting elements in neighboring regions of a display device by increasing the data value within regions of the display where the loss of voltage is likely to produce a loss of luminance. This method may comprise the following steps shown in FIG. 6 (e.g., when employed for an OLED display): 1) determining 110 the light emitting elements in the display device in each region, 2) receiving 112 an input image signal, 3) estimating 114 the current that each power line will provide at one or more OLEDs along the power line, 4) estimating 116 the voltage loss at the power supply and return connections of at least one pixel driving circuit due to IR drop along each power line, 5) determining 118 one or more correction factors based on the voltage loss, 6) applying 120 the one or more correction factors to the image signal to reduce unintended current variations for neighboring OLEDs within different regions, and 7) displaying 122 the corrected image signal.

Once again, a perfect correction is not required but the luminance difference between neighboring regions, when displaying a target such as the one shown in FIG. 3, should be less than 10 percent for imaging displays, less than 5 percent for graphical displays, and preferably less than 2 percent for the maximum voltage drop. This method also allows the luminance loss within a region to be corrected and ideally, this luminance loss will be less than 2 percent for any neighboring pixels and less than 20 percent along the entire length of the power line.

These embodiments may each be further described and will be dependent upon the characteristics of the display device on which they are implemented. In one preferred embodiment, the display may consist of rows or columns of red, green and blue light emitting elements, each row or column being driven by an individual power line. Within this embodiment, the IR drop may be different for the differently colored light emitting elements. Therefore, it is not only possible to have nonuniformities in image luminance but to also have color errors as the IR drop may be higher for one region of light emitting elements having a first color than for a neighboring region of light emitting elements having a second color.

Figure 7:
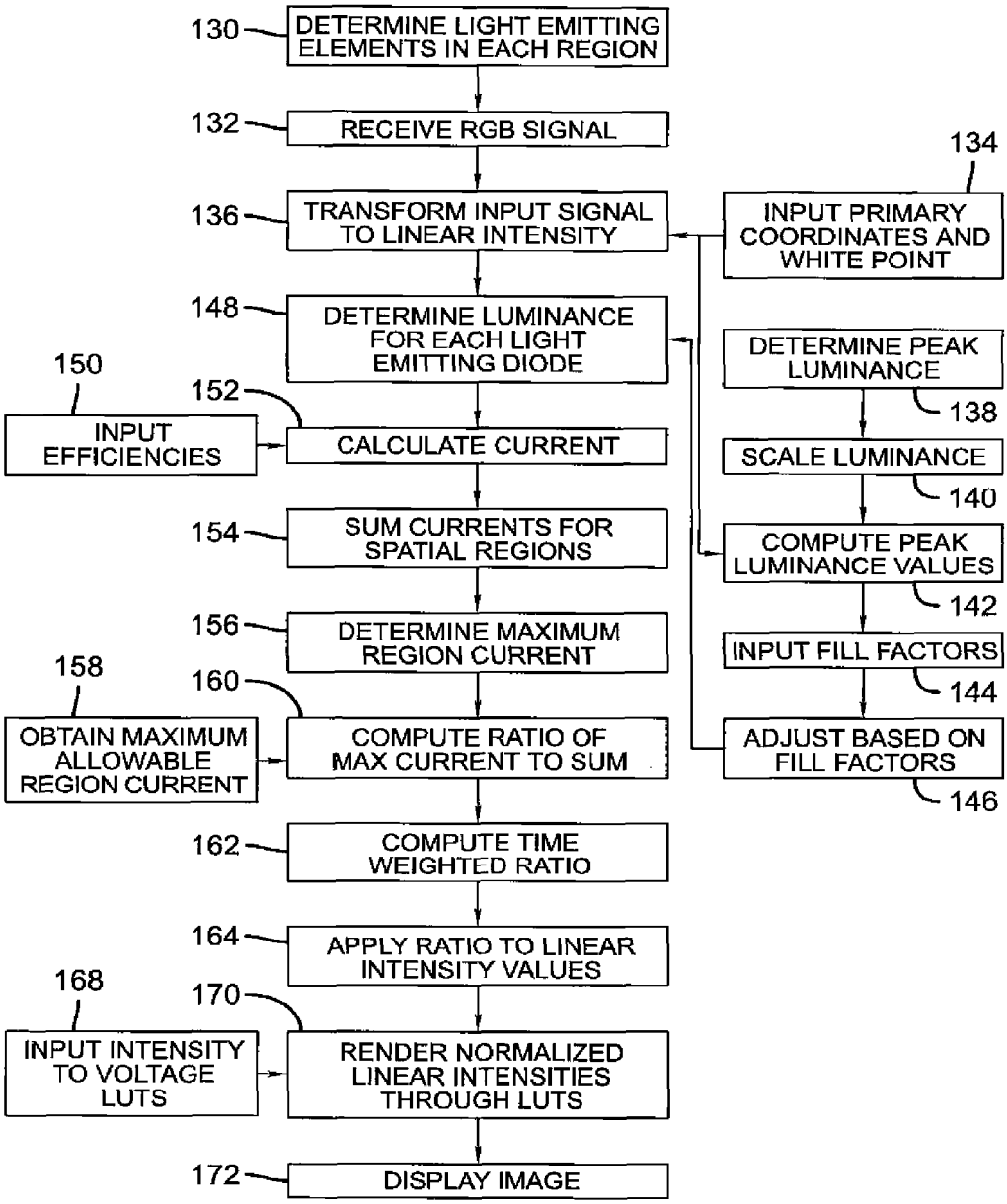
FIG. 7 is a flow diagram depicting a detailed set of steps for driving a display according to an embodiment of the present invention.

In such an embodiment, the display driver may utilize a process as depicted in FIG. 5. One possible version of this process, providing a more detailed implementation, is shown in FIG. 7. As shown in FIG. 7, the light emitting elements in each region are determined 130. This determination will be stored or encoded within the display driver. The display driver will then receive 132 an input image signal, which may be encoded into any color space, including for example in sRGB color space.

In an optional step, the primary coordinates of the display and white point may be input 134 and used to transform 136 the input RGB signal to linear intensity. This transformation to linear intensity will often involve a look-up table to transform the input values, which are often in a gamma-encoded color space, to values that are linear with the desired luminance output of the display. This transform may also include a matrix rotation to account for differences between the assumed chromaticity coordinates of the display primaries and the chromaticity coordinates of the actual display primaries. It should be noted that performing these optional steps is preferred for OLED displays as the current used to drive an OLED is approximately linearly related to the output luminance of the display so the transformation of the input image to a color space that is linear with output display luminance improves the accuracy or simplifies the estimation of the aim current to each OLED. Other optional steps, such as additional color or spatial processing of the linear intensity values may also be performed such that the resulting values are as representative of the values that are to be displayed.

To estimate currents, it is then necessary to convert the linear intensity values to luminance values. To accomplish this, the peak white point of the display is determined 138. This value may be stored within the display driver. This value may then be scaled 140 according to other influences such as a user control, an ambient light sensor, or a temperature sensor that may be used to provide scale values to this peak white luminance of the display. Knowing the final peak white point of the display, the chromaticity coordinates of the display primaries and the white point of the display may be used to compute 142 the peak luminance value for each color channel using techniques known in the art. Fill factors are then input 144 for each color of light emitting element. These values represent the proportion of the total display area that emits each color of light. The peak luminance values for each color channel obtained in step 142 are then adjusted 146 based upon the fill factors for color of light emitting element that were obtained in step 144. As an example of this adjustment, if only 10% of the light emitting area of the display emits light of a given color, then the peak luminance of light emitting elements of that given color must be 10 times the luminance computed in step 142 to achieve the desired peak luminance value when averaged across the entire display panel. The desired luminance intensity for each light emitting element may then be determined 148 by multiplying the linear intensity values by the peak luminance values for each light emitting element of a given color.

To calculate the current required, the efficiencies are then input 150. These efficiencies relate current to peak luminance values. Since the relationship between current and luminance are approximately linearly related, these efficiency values may be single scalars for each color of light emitting element but may be modeled using more complex formula, such as a scalar and an offset or even a nonlinear function relating current to luminance. These input efficiencies are then applied to calculate 152 the current required to obtain the luminance intensity values as computed in step 148. It should be further noted that while this set of computations appear relatively complex, many simplifications may be made in practice. For example, some or all of the steps 138, 142, 144, 146, and 150, may be combined to compute a single value that can be scaled according to step 140 and the resulting value may be used to calculate 152 current from the intensity values determined in step 148. This combination process may be done during design of the product and the final value stored within the display driver 78.

Once the current is calculated for each point, the current is summed 154 for each spatial region. The maximum of these sums are then determined 156. A maximum allowable region current is then obtained 158. This value represents the maximum current that a power line may supply while still having maximum voltage loss that when compared to the voltage loss of the neighboring region will not create objectionable image artifacts. This value may be a theoretical value, determined, for example, by assuming that one region consisted of a high current region nearer the power line connector than a lower current region, where the lower current region draws as little current as possible and determining that the resulting change in luminance between a uniform region displayed at the maximum distance from the power connector and bridging the two regions is within the limits mentioned earlier. Using this value, a ratio is then computed 160 between this maximum region current and the maximum allowable region current. This ratio is then subjected to smoothing operation such as computing 162 a time weighted ratio of this value with a plurality of the most recent values that were calculated for the respective most recently displayed images. This time weighted ratio is then applied 164 to the linear intensity values computed in step 136. Finally, in a voltage driven system, look-up-tables are input 168 that provide a conversion from image intensity to a metric that is linear with the voltage values that are used to drive the final display. The values obtained in step 164 are then rendered 170 using these look-up-tables and displayed 172.

It will be recognized, that numerous modifications can be made to the process shown in FIG. 7 while fulfilling the more general steps shown in FIG. 5. For instance, it might be noted that by completing steps 156 through 164 the maximum unintended variation between any of the regions is constrained. However, as noted before, this is not a necessary condition as the unintended variation may be larger if spread over a large portion of the display rather than occurring within a localized area of the display. Therefore, the maximum difference in current between two neighboring regions is less than the maximum difference in current between regions that are separated by a large spatial expanse. This fact may be utilized by replacing steps 156 through 164 with steps that involve applying a low pass filter to the currents for each spatial region, normalizing the peak of the resulting function to the maximum region current and then determining the ratio of the resulting values to the maximum allowable region current. The resulting values may be normalized by the maximum allowable region current. These values, or some time-weighted version of these values may then be applied to the linear intensities within each region before rendering 170 them.

The process in FIG. 7 normalizes the three differently colored light emitting elements equally. It is also possible that one may wish to calculate the maximum current for any of the color channels and use these individual values to apply different normalizations to the three different color channels. It should be noted that localized color biases may be present if these different normalization constants are used. However, users may find some level of these color errors acceptable and by applying different weightings the perceived brightness of the image may be increased without introducing objectionable color errors.

Figure 8:
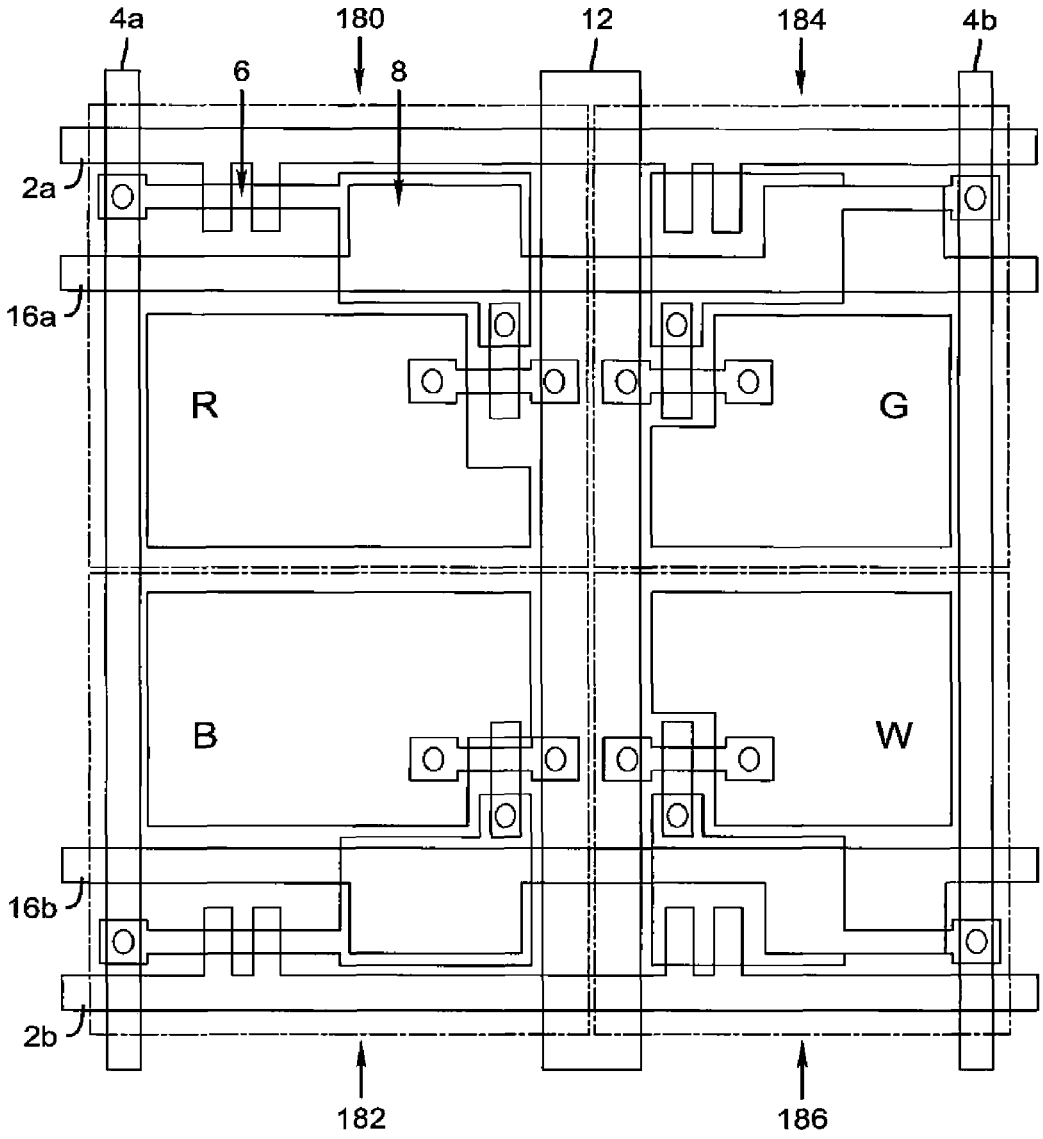
FIG. 8 is a top view of a display substrate for a display useful for practicing an embodiment of the present invention.

The display device shown in FIG. 2 may be a monochrome, a multi-color, or full color display device. A full color display device may be a three-color display device, employing, for example red, green, and blue light emitting elements. However, the display device may provide more than three colored light emitting elements. The light emitting elements may for example include red, green, or blue light emitting elements in addition to yellow, cyan, magenta, or white light emitting elements. One embodiment employing more than three color of light emitting elements is shown in FIG. 8. As shown in this figure, the display may be comprised of red 180, blue 182, green 184, and white 186 light emitting elements. As shown in FIG. 8, the display elements are each configured similarly to the display device as shown in FIG. 2 with each element is driven by a select line 2*a* or 2*b*, a data line 4*a* or 4*b*, a select TFT 6, a capacitor 8, a power TFT 10, a supply power line 12, OLED 14, a capacitor line 16*a* or 16*b* and a return power line 18 (not shown) which provides a connection to ground. The supply power line 12 is shared between each of the four or more colored elements in the embodiment of FIG. 8, a feature that is beneficial to, but not required by the present invention.

It is important to note that the process shown in FIG. 7 must be modified when it is to be used in conjunction with a display device having more than three colors of light emitting elements as the device will typically receive an RGB signal that must be converted to a signal to drive four or more color light emitting elements. To implement such a conversion process, an additional set of processing is preferably inserted between step 136 wherein the input signal is converted to an RGB linear intensities and step 148 wherein the luminance is determined for each light emitting diode. Any number of three to four color conversion processes may be employed between these two processing steps; including those discussed in U.S. Pat. No. 6,897,876, entitled "Method for transforming three colors input signals to four or more output signals for a color display", U.S. Pat. No. 6,885,380, entitled "Method for transforming three colors input signals to four or more output signals for a color display", and US 2005/0212728 entitled "Color OLED display with improved power efficiency", which are herein included by reference.

In a specific embodiment, display systems of the invention accordingly may contain more than three different colors of light emitting elements, and the display driver transforms a three-color input image signal to a four or more color image input signal, and generates the converted image signal for driving the light emitting elements in the display as a function of the four or more color input image signal and estimated currents that would result at, at least, one point along each power line if employed without further modification of the four or more color input image signal. The display may contain light emitting elements having colors to form at least three gamut defining primaries and at least one additional colored light emitting element that provides an in-gamut color. Alternatively, the display may contain light emitting elements having colors to form at least three gamut defining primaries and at least one additional colored light emitting element that provides a gamut expanding color.

While any color conversion process may be employed within such a display device, it is desirable that the color conversion process for a display device having red, green, and blue light emitting elements with at least one additional color light emitting element be performed such that a proportion of the red, green, or blue linear intensity values are subtracted from the input red, green, and blue linear intensity values and added to the linear intensity values for the at least one additional color light emitting element. Note that in the case that the at least one additional color light emitting element is more efficient than one or more of the red, green, and blue light emitting elements, less current will typically be required to display an image using the modified linear intensity values as discussed in US 2005/0212728 entitled "Color OLED display with improved power efficiency" and US 2004/0113875 entitled "Color OLED display with improved power efficiency" which are hereby incorporated by reference. As such, the use of four or more light emitting elements in the display device may reduce the overall current demand of the display device and reduce the ratio of the maximum current to the sum that is computed in step 160 of FIG. 7, reducing the magnitude of the difference in the converted image signal.

Figure 6:
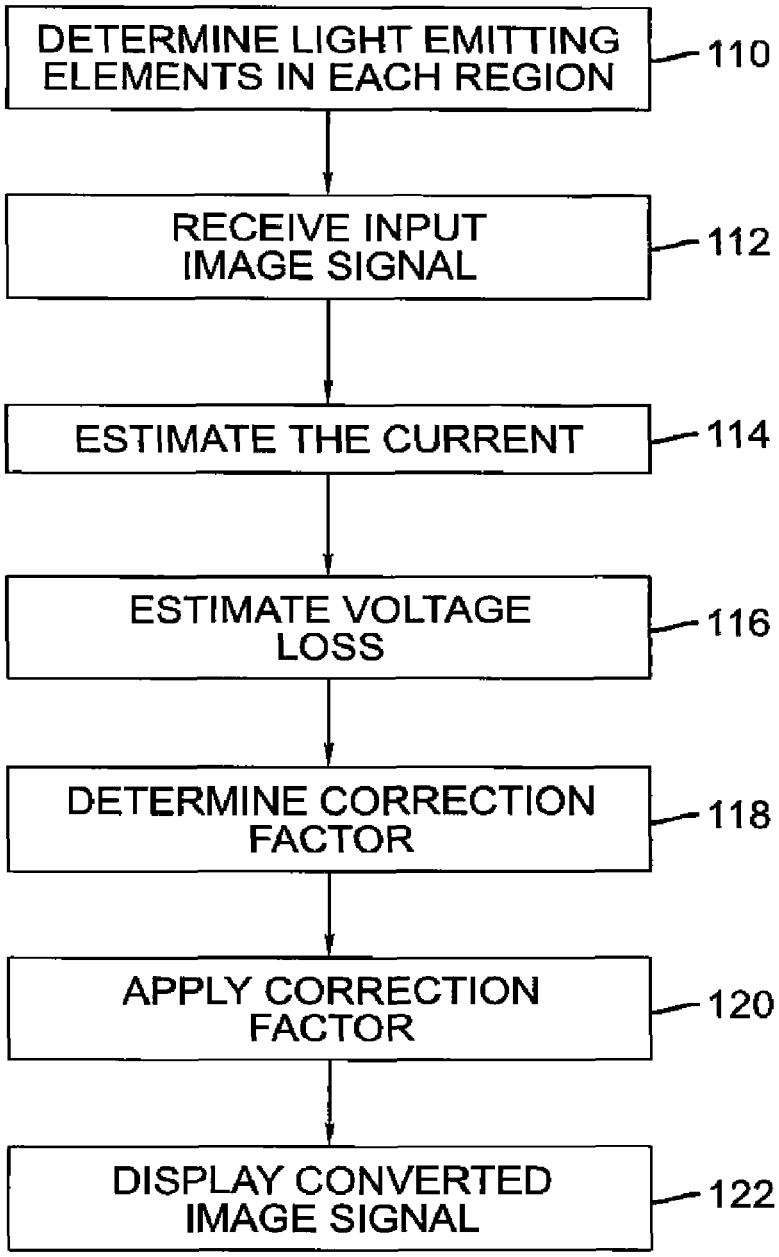
FIG. 6 is a flow diagram depicting steps of an alternate process for driving a display according to another embodiment of the present invention.
Figure 9:
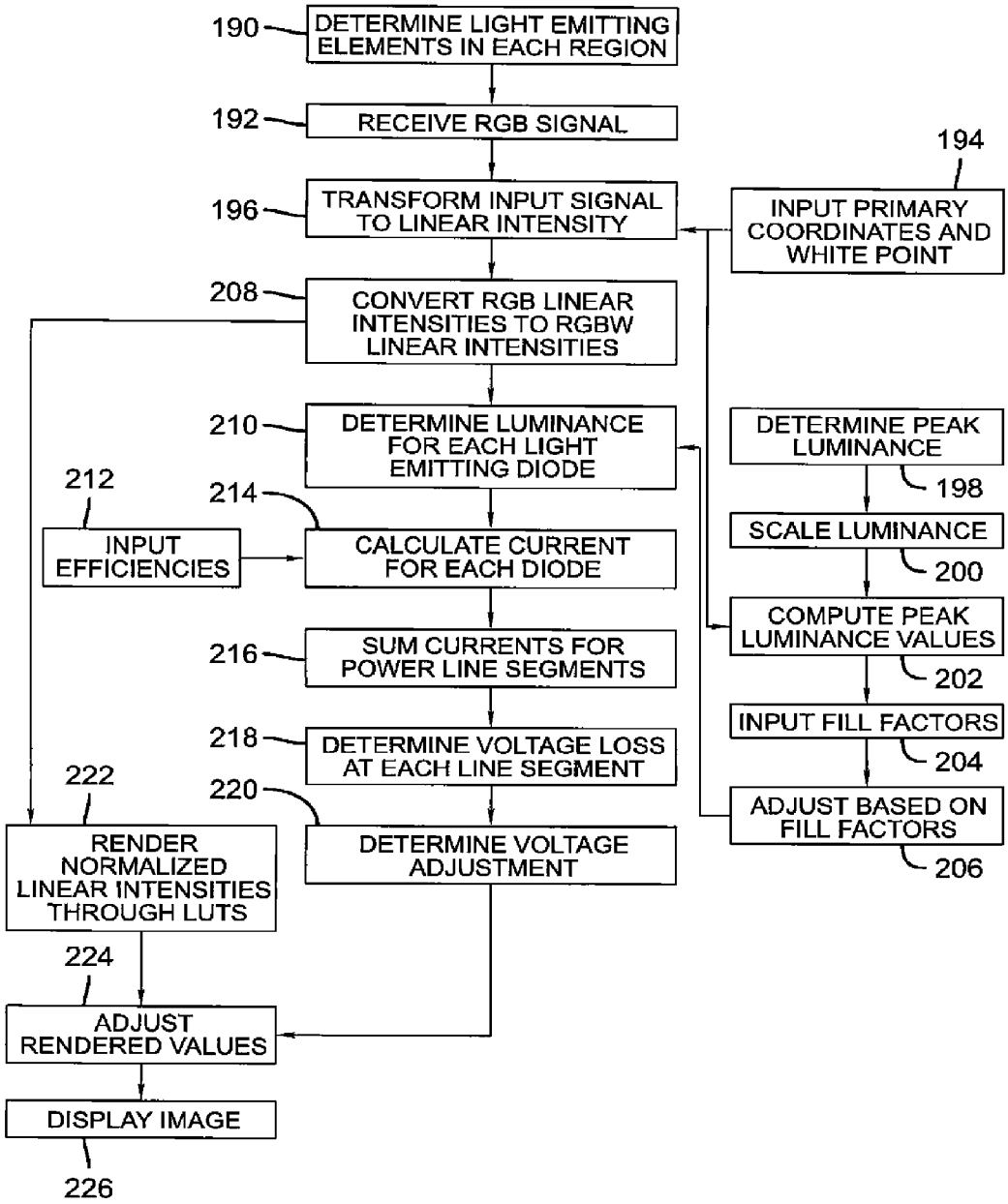
FIG. 9 is a flow diagram depicting an alternate detailed set of steps for driving a display according to anther embodiment of the present invention.

The embodiments that have been described thus far employed the method as depicted in FIG. 5. However, as noted before, an alternative embodiment may be employed in which the display driver limits the unintended variation in current draw between light-emitting elements in neighboring regions of the display device by increasing the data value within regions of the display where the loss of voltage is likely to produce a loss of luminance as shown in FIG. 6. One specific embodiment of this second method is more fully depicted in FIG. 9 for the display device depicted in FIG. 8. As shown in FIG. 9, the light emitting elements in each region are determined 190. This determination will be stored or encoded within the display driver. The display driver will then receive 192 an input image signal, which may be encoded into any color space, including for example in sRGB color space.

In an optional step, the primary coordinates of the display and white point may be input 194 and used to transform 196 the input RGB signal to linear intensity. This transformation to linear intensity will often involve a look-up table to transform the input values, which are often in a gamma-encoded color space, to values that are linear with the desired luminance output of the display. This transform may also include a matrix rotation to account for differences between the assumed chromaticity coordinates of the display primaries and the chromaticity coordinates of the actual display primaries. These optional steps are preferred for OLED displays as the current used to drive an OLED is approximately linearly related to the output luminance of the display so the transformation of the input image to a color space that is linear with output display luminance improves the accuracy or simplifies the estimation of the aim current to each OLED. Other optional steps, such as additional color or spatial processing of the linear intensity values may also be performed such that the resulting values are as representative of the values that are to be displayed. For the display shown in FIG. 8, it is necessary to convert 208 the RGB linear intensity values into RGBW linear intensity values. This may be accomplished as discussed earlier but will generally entail determining the minimum of the RGB linear intensity values for each pixel, subtracting a portion of this value from each or the RGB linear intensity values, and creating a white value that is composed of a proportion of the minimum of the RGB linear intensity values.

To estimate currents, it is then necessary to convert the linear intensity values to luminance values. To accomplish this, the peak white point of the display is determined 198. This value may be stored within the display driver. This value may then be scaled 200 according to other influences such as a user control, an ambient light sensor, or a temperature sensor that may be used to provide scale values to this peak white luminance of the display. Knowing the final peak white point of the display, the chromaticity coordinates of the display primaries and the white point of the display may be used to compute 202 the peak luminance value for each color channel using techniques known in the art. Fill factors are then input 204 for each color of light emitting element. These values represent the proportion of the total display area that emits each color of light. The peak luminance values for each color channel obtained in step 202 are then adjusted 206 based upon the fill factors for color of light emitting element that were obtained in step 204. As an example of this adjustment, if only 10% of the light emitting area of the display emits light of a given color, then the peak luminance of light emitting elements of that given color must be 10 times the luminance computed in step 202 to achieve the desired peak luminance value when averaged across the entire display panel.

The desired luminance intensity for each light emitting element may then be determined 210 by multiplying the linear intensity values for the RGB values by the peak luminance values for each light emitting element of a given color and multiplying the linear intensity value for the W channel by the sum of the RGB peak luminance values.

To calculate the current required, the efficiencies are then input 212. These efficiencies relate current directly to peak luminance values. Since the relationship between current and luminance are approximately linearly related, these efficiency values may be single scalars for each color of light emitting element but may be modeled using more complex formula, such as a scalar and an offset or even a nonlinear function relating current to luminance. These input efficiencies are then applied to calculate 214 the current required to obtain the luminance intensity values as computed in step 210. It should be further noted that while this set of computations appear relatively complex, many simplifications may be made in practice. For example, some or all of the steps 198, 200, 202, 204, and 206, may be combined to compute a single value that can be scaled according to step 210 and the resulting value may be used to calculate 214 current from the intensity values determined in step 208. This combination process may be done during design of the product and the final value stored within the display driver 78.

Figure 10:
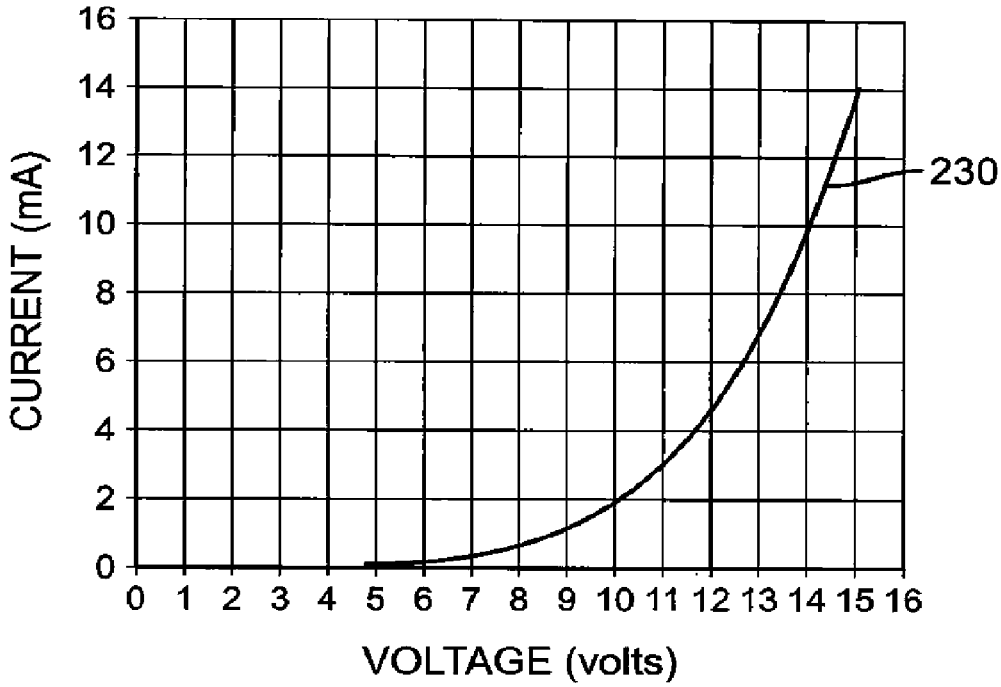
FIG. 10 is a diagram depicting a relationship between voltage and current in a typical organic light emitting diode useful for practicing embodiments of the present invention.

Once the current is calculated for each point, the current is summed 216 for numerous points along the power line. Note that ideally this calculation would be performed by summing the current for each light emitting element that proceeds the point of calculation along the power line. That is, for the light emitting element closest to the power supply, the currents for all of the light emitting elements would be summed. For the next light emitting element, the values for all except the first light emitting element would be summed, etc. This step provides an estimate of the current at each point along the power line. The next step is to determine 218 the voltage loss due to IR drop along the power line. This may be accomplished by computing the summed current at each light emitting element by the resistance of the power line between any two light emitting elements. This provides an estimate of voltage loss between any two points along the power line. To determine the voltage loss from the beginning of the power line to each light emitting element, the voltage loss is summed across all light emitting elements that precede the light emitting element of interest along the power line. A voltage adjustment is then determined 220. One such adjustment is to determine an adjustment value that is equal to the voltage loss. While this will improve uniformity, it may not completely remove any uniformity bias since increasing the voltage at each OLED will increase the current that each OLED will require. The relationship 230 between voltage and current draw across a typical OLED is shown in FIG. 10. As this figure shows, increases in voltage will generally increase the current demand of the OLED, which will further increase the voltage loss across the bus. While it is possible to perform an optimization procedure to correct for this interdependent relationship, it can also be noted that the ideal solution will tend towards higher voltages, and therefore a value greater than the voltage loss may be used as the voltage adjustment.

Returning to FIG. 9, the RGBW linear intensities converted in step 208 are then rendered through LUTs to convert them to a quantity that is linear with data voltage for each light emitting element. The rendered values are then adjusted 224 based upon the voltage adjustment values determined in step 220. The resulting adjusted rendered values are then used to display 226 the image. Notice that in this procedure the voltage loss will be largest at the point furthest from the power supply and when the currents along the power line are large. The adjustment will be smaller when the currents along the power line are small. In this way, this procedure can be used to improve the uniformity of the resulting images.

While the methods shown in FIGS. 5 and 6 are shown as two separate alternatives, it should be noted that it is also possible to combine these methods as they each require that the current be estimated at one or more points along the power line, and that the input signal be modified based upon this current estimate before it is displayed.

The embodiments provided have described application with voltage driving methods. Similar embodiments can be described for devices employing other active matrix circuits including pulse width modulated, voltage driven circuits and current driven circuits. Current driven circuits have been described by Date et al. in a paper entitled "Development of Source Driver LSI for AMOLED Displays Using Current Driving Method" published in the 2003 Proceedings of the Society for Information Display Conference. As described by this paper, the circuit generally provides a constant current to the OLED. Therefore the imaging artifacts present when this design is used are significantly different. In a current driven device, a reference current is provided to each light emitting element as long as the power line is able to supply the necessary current. However, the higher the current that must be provided within this circuit, the higher the voltage necessary for each power line. Further, the higher the current, the larger the IR drop and therefore the higher the voltage necessary for each power line. If the resistance of the power line is high enough, the power supply 72 will be incapable of providing the voltage necessary to support the current that is necessary to drive all of the light emitting elements within each power line. In this case, without applying the methods provided within this disclosure, the power line will not carry adequate current and therefore sufficient current will not be provided to at least some of the light emitting elements, providing dimmer or darker pixels than desired. In such a case, the display driver may implement the process as shown in FIG. 5 to limit the total current to a power line. This will result in a lower luminance image than is desired but will avoid imaging artifacts where some light emitting elements are less luminous than desired while others are as luminous as desired. It is also possible to calculate the maximum current that can be provided with a maximum voltage and to alter the input image signal such that the voltage for any power line does not exceed the maximum.

Although this disclosure has been primarily described in detail with particular reference to OLED displays, it will be understood that the same technology can be applied to any active matrix electroluminescent display device that produces light as a function of the current provided to the light emitting elements of the display. Within such devices IR drop may occur along a power line that is used to drive a plurality of such light emitting elements. For example, this disclosure may apply to electroluminescent display devices employing coatable inorganic materials, such as described by Mattoussi et al. in the paper entitled "Electroluminescence from heterostructures of poly(phenylene vinylene) and inorganic CdSe nanocrystals" as described in the Journal of Applied Physics Vol. 83, No. 12 on Jun. 15, 1998, or to displays formed from other combinations of organic and inorganic materials which exhibit electroluminescence and that can be driven by an active matrix pixel driving circuit.

It should be further noted that while the system and method described herein corrects for image non-uniformity produced by IR drop along a power line, the severity of these artifacts will vary significantly with changes in the input image signal. Other sources of non-uniformity may also exist in OLED and other electroluminescent displays. For example, variation in thin film transistor response may produce spatially stable non-uniformities that do not vary as a function of the input image signal. Methods for correcting these artifacts have been discussed in detail in co-pending, commonly assigned U.S. Ser. Nos. 10/894,729 filed Jul. 20, 2004, 11/093,115 filed Mar. 29, 2005, and 11/093,231 filed Mar. 29, 2005, the disclosures of which are hereby incorporated by reference. It should be acknowledged that systems of the present invention may additionally employ the methods described within these copending applications to correct the spatially stable non-uniformities produced by TFT variation in addition to the input image signal dependent non-uniformities that are addressed within the current disclosure. Although the order of application of these correction methods may not be particularly important, applications of the methods discussed within the current disclosure prior to employing other correction masks may be computationally less complex.

The invention has been described in detail with particular reference to certain preferred embodiments thereof, but it will be understood that variations and modifications can be effected within the spirit and scope of the invention.

PARTS LIST

2, 2*a*, 2*b* select line
4, 4*a*, 4*b* data line
6 select TFT
8 capacitor
10 power TFT
12, 12*a*, 12*b* supply power line
14 OLED
16, 16*a*, 16*b* capacitor line
18 return power line
20 gate
22 source in a p-type TFT or drain in a n-type TFT
24 drain in a p-type TFT or source in a p-type TFT
30 light emitting element
32 light emitting element
34 light emitting element
36 light emitting element
40 semiconductor region
42 second semiconductor region
44 power transistor gate
46 first electrode
48 via
50 via
52 via
54 via
60 white area
62 black area
64 black area
66*a*, 66*b*, 66*c* gray area
70 display system
72 power supply
74 display
76 display driver
78 power lines
82 light emitting elements
90 determining light emitting elements step
92 receiving input image signal step
94 estimating current step
96 determining correction factor step
98 applying correction factor step
100 display converted image step
110 determining light emitting elements step
112 receiving input image signal step
114 estimating current step
116 estimating voltage loss step
118 determining correction factors step
120 applying correction factor step
122 displaying corrected image step
130 determining light emitting elements step
132 receive image input signal step

134 input step
136 transform input to linear intensity step
138 determine peak white point step
140 scale value step
142 compute peak luminance step
144 input fill factor step
146 adjust peak luminance values step
148 determine desired luminance intensity step
150 input efficiencies step
152 calculate input efficiencies step
154 sum current step
156 determine sum step
158 obtain allowable current step
160 compute ratio step
162 compute smoothed value step
164 apply ratio step
168 input look-up-tables step
170 render step
172 display step
180 red light emitting element
182 blue light emitting element
184 green light emitting element
186 white light emitting element
190 determine light emitting element step
192 receive input image signal
194 input step
196 transform step
198 determine white point step
200 scale value step
202 compute peak luminance step
204 input fill factor step
206 adjust peak luminance values step
208 convert to RGBW linear intensity values step
210 determine luminance intensity step
212 input efficiencies step
214 calculate current step
216 sum current step
218 determine voltage loss step
224 adjust rendered values step
228 display image step
230 current v. voltage curve

The invention claimed is:

1. An electroluminescent display system, comprising:

a) a display composed of an array of regions, wherein the current to each of the regions is provided by a different pair of power lines, each having a resistance, and wherein each region includes an array of light emitting elements for emitting light and wherein the current provided to each light-emitting element is affected by the resistance of at least one of the corresponding power lines, the position of each light-emitting element along at least one of the corresponding power lines, and the current provided to other light-emitting elements within the array of light-emitting elements;

b) a pixel driving circuit for independently controlling the current to each light-emitting element in response to an image signal, wherein the intensity of the light output by the light emitting elements is dependent upon the current provided to each light emitting element; and c) a display driver for receiving an input image signal and generating a converted image signal for driving the light emitting elements in the display, wherein the display driver:

i) analyzes the input image signal to estimate the current that would result at at least one point along at least one of the power lines providing current to each of the regions, if employed without further modification, based upon device architecture, material and performance characteristics of device components, and the input image signal; and ii) generates the converted image signal as a function of the input image signal and the estimated currents;

and wherein when i) the input image signal includes a target area of desired uniform luminance that spans two or more regions and ii) the average input image signal for light emitting elements outside the target within one of the two or more regions is significantly higher than the average input image signal for light emitting elements outside the target within another of the two or more regions, the display driver modifies the input image signal such the average input image signal for light emitting elements outside the target is reduced or the input image signal for light-emitting elements within the target area and within the region having the significantly higher average input image signal is increased, so that the luminance pattern that results from displaying the image is more uniform in the target area when the converted image signal is used for driving the light emitting elements of the display than when the input image signal is used for driving the light emitting elements of the display.

2. An electroluminescent display system, comprising:

a) a display composed of an array of regions, wherein the current to each of the regions is provided by a pair of power lines, each having a resistance, and wherein each region includes an array of light emitting elements for emitting light and wherein the current provided to each light-emitting element is affected by the resistance of at least one of the corresponding power lines, the position of each light-emitting element along at least one of the corresponding power lines and the current provided to other light-emitting elements within the array of light-emitting elements;

b) a pixel driving circuit for independently controlling the current to each light-emitting element in response to an image signal, wherein the intensity of the light output by the light emitting elements is dependent upon the current provided to each light emitting element; and c) a display driver for receiving an input image signal and generating a converted image signal for driving the light emitting elements in the display, wherein the display driver analyzes the input image signal to estimate the current that would result at, at least, one point along at least one of the power lines providing current to each of the regions, if employed without further modification, based upon device architecture and material and performance characteristics of device components, and generates the converted image signal as a function of the input image signal and the estimated currents;

wherein the display driver generates the converted image signal as a function of one or more normalization constants based on the relative values of the estimated current values and a reference value.

3. The display system according to claim 2, wherein the display driver estimates peak currents for each power line and computes a normalization constant based on the ratio of the maximum estimated peak current to the reference value, and applies the normalization constant to the input image signal to generate the converted image signal.

4. The display system according to claim 2, wherein the display driver generates the converted image signal by computing modified normalization constants for each region as a filtered version of an initial set of normalization constants computed for neighboring regions.

5. The display system according to claim 2, wherein the display driver generates converted image signals for individual input image signals in a temporal image sequence by computing modified normalization constants for the multiple input image signals as a filtered version of an initial set of normalization constants computed for individual images in the sequence.

6. An electroluminescent display system, comprising:

a) a display composed of an array of regions, wherein the current to each of the regions is provided by a different pair of power lines, each having a resistance, and wherein each region includes an array of light emitting elements for emitting light and wherein the current provided to each light-emitting element is affected by the resistance of at least one of the corresponding power lines, the position of each light-emitting element along at least one of the corresponding power lines and the current provided to other light-emitting elements within the array of light-emitting elements;

b) a pixel driving circuit for independently controlling the current to each light-emitting element in response to an image signal, wherein the intensity of the light output by the light emitting elements is dependent upon the current provided to each light emitting element; and c) a display driver for receiving an input image signal and generating a converted image signal for driving the light emitting elements in the display, wherein the display driver analyzes the input image signal to estimate the current that would result at, at least, one point along at least one of the power lines providing current to each of the regions, if employed without further modification, based upon device architecture, material and performance characteristics of device components, and the input image signal and generates the converted image signal as a function of the input image signal and the estimated currents;

wherein the analysis of the input image signal to estimate the current includes converting the input image signal to a signal that is linear with luminous intensity of the display device.

* * * * *